US005683080A

United States Patent [19]

Vaioli et al.

[11] Patent Number: 5,683,080

[45] Date of Patent: Nov. 4, 1997

[54] VIDEO CONTROL EQUIPMENT FOR DETECTING PINFALL AT THE GAME OF BOWLING

[75] Inventors: Roberto Vaioli, Bologna; Emanuele Govoni, San Matteo della Decima; Luca Drusiani, Anzola dell 'Emilia, all of Italy

[73] Assignee: Qubica S.r.l., San Matteo della Decima, Italy

[21] Appl. No.: 543,253

[22] Filed: Oct. 18, 1995

Related U.S. Application Data

[63] Continuation of Ser. No. 279,937, Jul. 25, 1994, abandoned.

[30] Foreign Application Priority Data

May 31, 1994 [IT] Italy ..... BO94A-253

[51] Int. Cl.[6] ..... A63D 5/04

[52] U.S. Cl. ..... 473/69; 473/58; 473/70; 473/101

[58] Field of Search ..... 473/54, 55, 57, 473/58, 64, 68, 67, 69, 70, 71, 86, 101

[56] References Cited

U.S. PATENT DOCUMENTS

| | | | |
|---|---|---|---|
| 3,847,394 | 11/1974 | Logemann, Jr. et al. . | |
| 4,225,924 | 9/1980 | Turjillo | 473/70 |
| 4,302,010 | 11/1981 | Kaenel | 473/70 |
| 4,827,412 | 5/1989 | Form | 473/69 |
| 4,893,182 | 1/1990 | Gautraud | 473/58 |
| 5,241,379 | 8/1993 | Tsujta . | |
| 5,255,185 | 10/1993 | Mowers et al. . | |

FOREIGN PATENT DOCUMENTS

| | | | |
|---|---|---|---|
| 9008580 | 8/1990 | WIPO | 473/70 |

OTHER PUBLICATIONS

Bowling Magazine, "Rapid Score", Feb. 1973, pp. 22–23.

*Primary Examiner*—V. Millin
*Assistant Examiner*—William M. Pierce
*Attorney, Agent, or Firm*—Dvorak and Traub

[57] ABSTRACT

Bowling lanes are equipped typically with first monitoring devices serving to verify the position of the pins and second monitoring devices designed to detect the passage of the balls, also a first control station connected both to the first and second monitoring devices and to the actuator of a machine for recovering and setting up the pins, in such a way that the game can be run and supervised according to a selected program and on the basis of the information received in signals returned by the two sets of monitoring devices; in the equipment disclosed, the first and second monitoring devices are incorporated into a single assembly together with a second control station interfaced with the program and connected to a communications network of which the first control station forms a part.

2 Claims, 2 Drawing Sheets

5
51
60
6
31
32'
32
44
16
9
1
7
4
2
21
22
α
16'
49
40
V
3
10
33

V
R
10
6
21
22
42
41
16
16
16
16'
M
6'
6
7
4
2
1
8
5
3
9
6
4
40
32
32
33
44

VIDEO CONTROL EQUIPMENT FOR DETECTING PINFALL AT THE GAME OF BOWLING

This application is a continuation of application Ser. No. 08/279,937, filed Jul. 25, 1994 now abandoned.

BACKGROUND OF THE INVENTION

The present invention relates to control equipment for the game of bowling at pins, and in particular to equipment that comprises monitoring and control devices such as will govern the operation of one or more bowling lanes.

It is increasingly the practice for bowling centers to offer a series of optional services such as, for example, the automatic computation of scores or of competition places achieved by different players. To this end it has become normal for the classic tenpin bowling lane, which essentially comprises a flat elongated playing surface and a machine for recovering and setting up the pins, to be fitted with auxiliary equipment, in some cases operated from a personal computer, capable of controlling the access of players to the various lanes and of calculating their points scores, payments, results, places, etc..

Using the latest techniques, the various stages of the game are overseen by software programs capable of commanding and/or controlling the start of each session, the turns taken by the individual players, the scores, and the start and stop maneuvers of the machine by which the pins are recovered and set up on the playing surface, etc.

For the various stages of play to occur in regular succession, or at least to ensure correct timing between the decisions of the software program and the effective state of the game, equipment must be installed such as will monitor a given number of parameters differing in composition from center to center according to the level of complexity in the particular facility, i.e. in the different services offered to customers.

Equipment of the type in question will generally comprise devices installed at the target end of the lane, which are described more fully in due course, serving respectively to identify the number of pins knocked over and to verify the passage of the ball beyond the pins. The information returned by these devices is used in the computation of scores and to pilot the operation of the machine which recovers and sets up the pins, or indeed for other optional functions such as, for example, calculating the velocity of the ball.

The device widely adopted for monitoring the pins is a scanner, that is to say an optical transducer, positioned to one side of the lane and trained on the area occupied by the pins, such as will produce an output signal indicating the presence or absence of the pins. The signal produced by the scanner can be reconstructed in such a manner as to generate a graph, or at least a succession of curves of which the peaks correspond to the positions of the pins left standing on the bowling surface. In the event of errors occurring with this system, the effective reading of the scanner cannot easily be verified, except by skilled technicians and in any case not without a notable loss of time; it can happen for instance that spurious objects, such as a portion of the element that sweeps up the fallen pins, are read mistakenly as pins standing on the surface.

Such eventualities constitute a drawback in systems which utilize a scanner. Moreover, the installation of a scanner involves tricky mechanical adjustments and a complicated calibration procedure which may dictate the need, for example, to use templates for the purpose of aligning the scanner optics on the relative part of the lane.

The passage of a ball beyond the pins can be sensed by devices of various types: one such is the simple backstop, effectively a bar or rail equivalent in length to the width of the playing surface, which is placed across the end of the lane and indicates the arrival of the ball by triggering a signal when struck. This mechanical device has been superseded in newer installations by devices with photocells of which the beam is directed across the lane, near the pins, at a point through which the ball passes immediately prior to its passage through the area occupied by the pins. With the passage of the ball, the photocell device emits a signal such as can be utilized by associated electronic control circuits to activate the device monitoring the fall of the pins, and thereafter, to relay a start signal to the machine which recovers and sets up the pins.

The installation of devices serving to monitor the passage of the ball requires considerable care, and moreover, in obtaining a correct synchronization of the various components which govern the operation of the lane (especially the exact timing of the instant when a reading is made), the association of the different items of hardware with the lane is a time-consuming process of which the impact can be negative.

In centers where a software program is installed, each lane or pair of lanes will be equipped with a control station connected to a central processing unit forming part of a control center coinciding generally with the cash desks. By means of suitable commands, the CPU (generally a computer capable at least of storing data), will enable access to the various lanes and remain configured to receive data from the respective stations, which at very least will indicate the number of games completed so as to allow calculation of the sums payable by the users. In practice, these stations can consist of packaged electronic components suitably connected to a computer located at the cash point.

A screen showing the scores and the frames will be installed generally at the approach to the lane, from where the ball is delivered, and, associated with the screen in some instances, a keyboard which can be used by the players to enter data.

The link-up of the components utilized for control and management of the game requires a significant number of connections between the various stations serving each pair of lanes, the central processing unit, the screens and the devices monitoring the fall of the pins and the passage of the ball.

Accordingly, the object of the present invention is to overcome the various drawbacks outlined above, by providing control equipment for bowling such as will afford an easy installation of the monitoring devices utilized, optimization of the image relayed by the device monitoring the fall of the pins, and simple connections both between the different parts of the single bowling lane and between the various lanes installed in the center.

SUMMARY OF THE INVENTION

The stated object is realized, in control equipment according to the present invention, through the incorporation into a single assembly of means by which to monitor the position of the pins and means by which to monitor the passage of the balls; also associated with the equipment is a control station which can be connected to a machine of conventional type for setting up and recovering the pins, and connected also to a central control unit capable of functioning interactively with the monitoring means in response to a selected game program.

The monitoring means consist in a television camera capable of viewing the position of the pins and of producing a signal that can be interpreted by the program software, and a photocell device detecting the passage of the balls; the equipment is provided further with fixing means allowing its association with a lateral area of the lane, for example such as a channel or a channel cover extending between two lanes paired in the conventional manner.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Referring to the accompanying drawings, in which true proportions are deliberately ignored so as to facilitate the illustration of certain components, the control equipment according to the invention is designed for association with a bowling lane of the type affording a predominantly longitudinal playing surface 1 extending between an approach end 2 from which balls 7 are delivered, and a target end 3 at which the balls are directed.

Figures 1, 2:
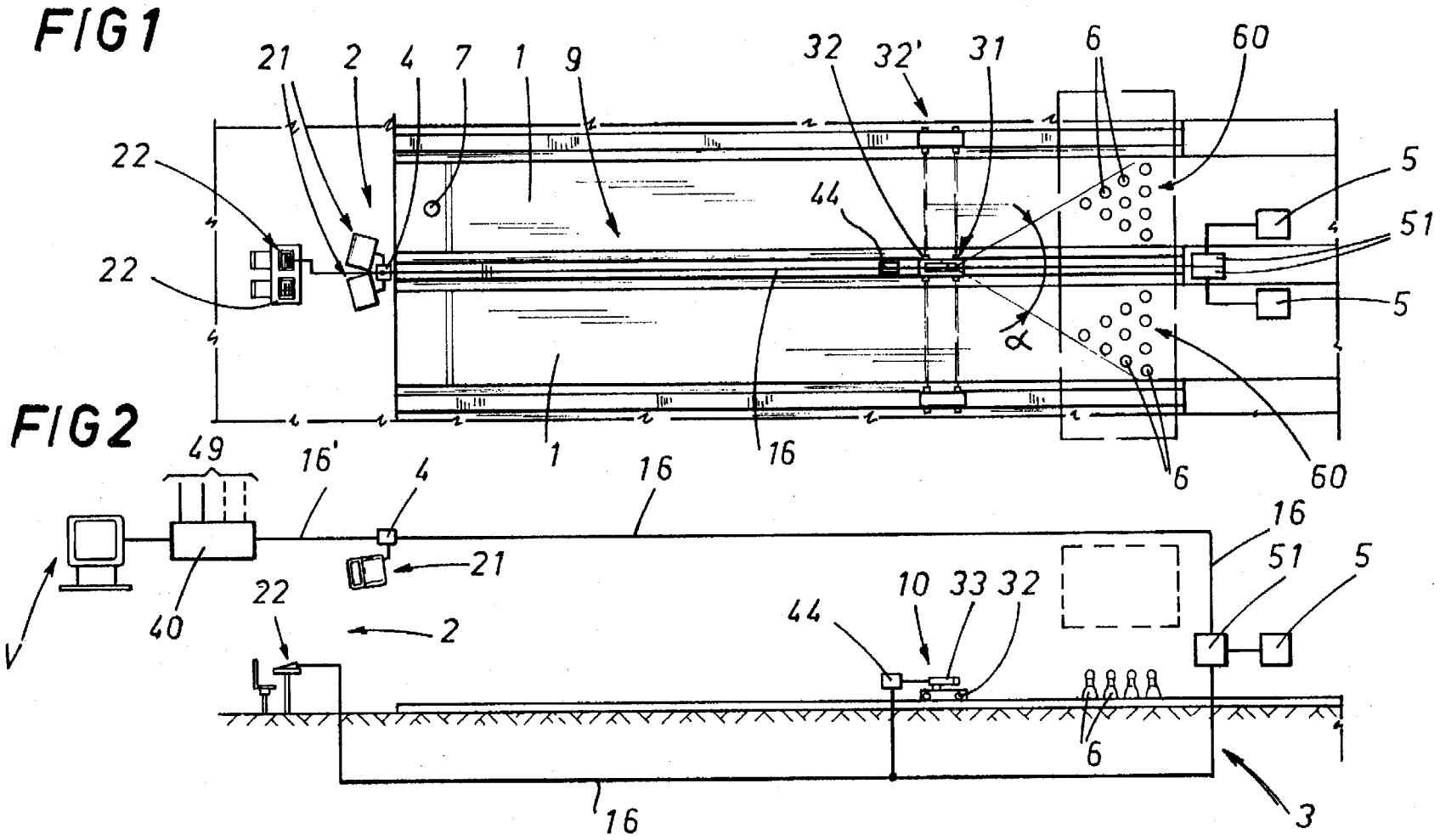
FIGS. 1 and 2 are schematic illustrations showing a typical pair of bowling lanes fitted with control equipment according to the present invention, viewed in plan from above and from the side, respectively.

By way of example, FIG. 1 illustrates two such lanes paired together in an arrangement almost invariably adopted in bowling centers.

Each of the two approaches 2 is provided with data display means 21, which might be a VDU, and data input means 22 (see FIG. 2) consisting typically in a keyboard.

The target end 3 of each lane is equipped with a machine by which pins 6 are recovered and set up in groups 60 on the playing surface 1; the machine is not illustrated graphically in the drawings, being conventional in embodiment and strictly incidental to the invention, but indicated schematically by a block denoted 5 and an actuator device denoted 51, of which the actuator 51 is capable of receiving or transmitting a relative input or output signal, for example start or stop, and in practice provides the connection between the machine 5 and the remainder of the system.

The lanes are served by first monitoring means 31 for verifying the position of the pins and second monitoring means 32 for verifying the passage of the balls 7.

Each lane or pair of lanes is equipped with a first control station 4, which in the example illustrated occupies a position near to the data displays 21 at the approach end 2; this first control station 4 is connected to at least one central control unit 40, to which further control stations 49 may likewise be connected in number according to the number of lanes installed in the center, or to the number of lanes conveniently manageable by the same central control unit.

The first control station 4 is connected both to the pin recovery and set-up machine 5 (by way of the actuator device 51) and to the first and second monitoring means 31 and 32, in such a way as will allow control over the sucessive stages of the game on the basis of a selected program and of the input signals returned by the monitoring means 31 and 32 (of which the operation is piloted by an electronic control unit to be mentioned in due course).

The equipment to which the invention specifically relates is incorporated into a single assembly 10 (FIG. 2) comprising the first monitoring means 31 for verifying the position of pins 6, the second monitoring means 32 verifying the passage of the balls 7, and a second control station 44.

The first monitoring means 31 are embodied as a television camera 33 of which the angle of view 2 compasses two groups 60 of pins standing on the two contiguous playing surfaces 1 (FIG. 1).

The second control station 44 functions as an interface interacting with the software program overseeing the stages of the game and is connected into a communications network 16 incorporating the dialogue one with another by way of respective connections capable of receiving and transmitting signals.

The second monitoring means 32 comprise at least one photocell device, and at least one reference element disposed on the far side of the relative playing surface 1 in alignment with the photocell. The equipment further comprises means by which it can be fastened to a portion of the lane alongside the playing surface 1, for example a channel or a channel cover 9 created between the paired lanes.

In practice, the single assembly 10 might consist in a rigid support structure including at least one bracket (or other similar fixing element) such as can be fixed to the margin of the playing surface. In this way, the operations involved in installing the equipment are significantly simplified, since all that is required is to position the equipment on the channel cover 9 extending between the two paired lanes and to secure a bar 32', carrying the reference elements for the photocells 32, on the opposite side of each playing surface 1.

The second control station 44 is connected, either directly or by way of the first station 4, to the central control unit 40. Using a suitable software package, it will be possible to preprogram a map M for use with the camera 33 to the end of defining a matrix of coordinates reflecting the arrangement of the groups 60 of pins 6.

Figure 3:
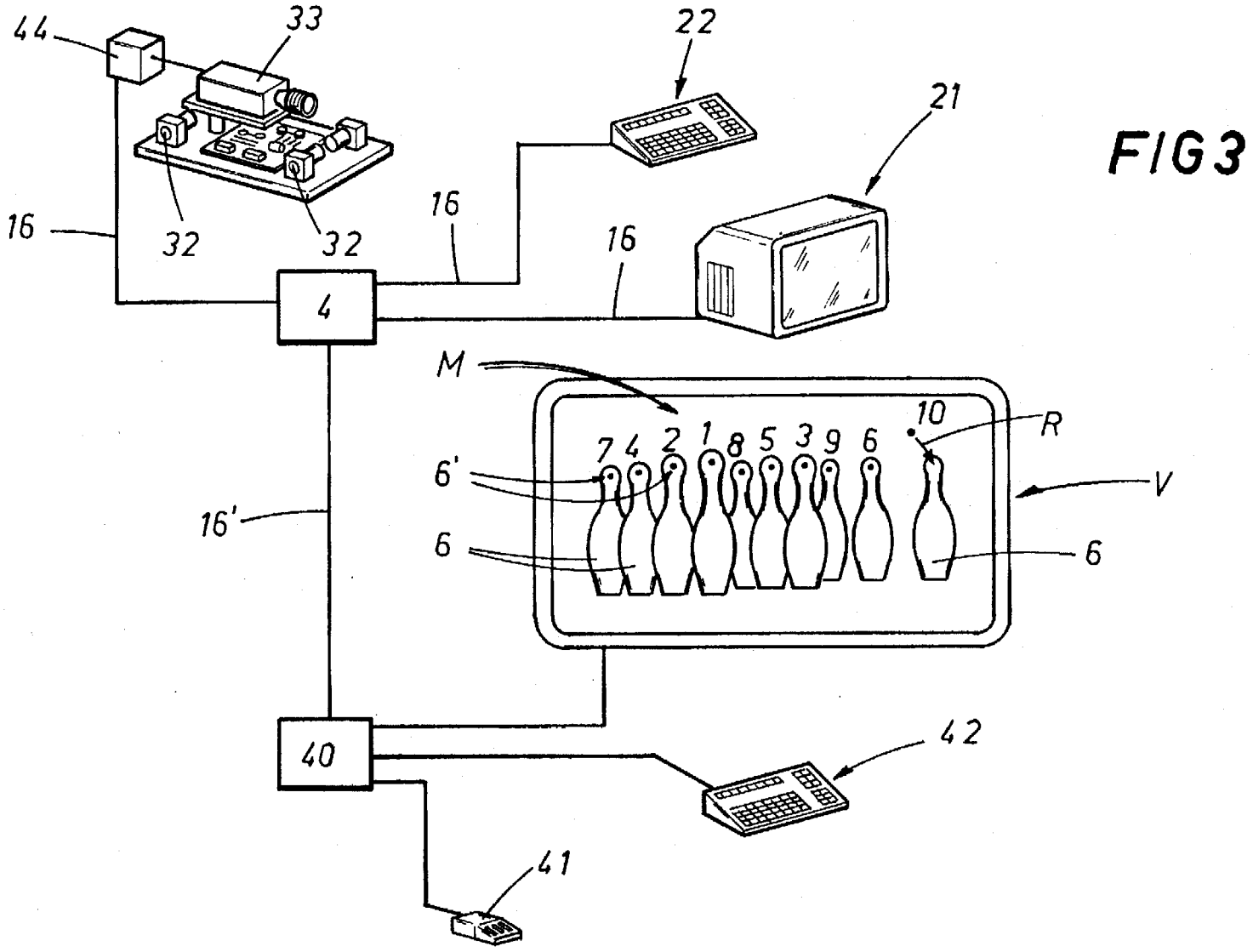
FIG. 3 illustrates a possible method of monitoring the position of the pins and encoding and decoding the relative signal.

FIG. 3 illustrates a video display unit, denoted V, indicating one possible arrangement of a group 60 of pins 6.

In operation, the output signal from the camera 33 is encoded and fed by way of the control station 44 (which might be an electronic circuit board) into the communications network 16, for utilization by the various stations and the various components connected to the network.

Among the uses to which the encoded signal derived from the camera images can be put is the computing of scores: comparison is made between the matrix M of points corresponding to the initial position of the pins and the encoded signal representing the position of the pins after delivery of the ball, and the score then calculated from the difference between matrix and signal.

The televised images generated at the displays 21 installed in the approach area can be decoded by the first control station 4 and retransmitted; as discernible from FIG. 3, moreover, any given signal carried by the network 16 can be relayed from the first control station 4 to a further network 16' connecting with the central control unit 40.

Points scores can thus be computed by the central control unit 40, in the manner already described, and the matrix M can be programmed in an extremely simple manner.

In effect, the signal can be decoded to reproduce the camera image on the video display unit V, and a conventional input device such as a mouse 41 or a keyboard 42 then used to position a cursor (which could be numbered to indicate the corresponding pin as in FIG. 3) at the effective location of the pin in such a way as to create a matrix M of reference dots 6' against which to compare the encoded signal generated after the delivery of the ball.

For the sake of simplicity, FIG. 3 shows the image relative to one only of the two lanes covered by the camera 33, indicating a configuration of the matrix M with the cursor still to be positioned (by a movement denoted R) on pin number 10.

Even in the event of a malfunction, a check can be made on the affected lane directly from the central control unit 40, and therefore from the cash desk, by virtue of the fact that a video image of the current situation on the lane can be generated at a remote location.

The reference dots 6' can be positioned to coincide with the heads of the pins 6, thereby eliminating any possibility that the fall of a pin could go undetected.

The inclusion of the network 16 affords a further advantage, in that with connections established between all components, the network wiring can be exploited to carry both signals and power supply. If a transformer is incorporated into the first control station 4, for example, then all stations can be operated at a low voltage (e.g. 20 V), and utilizing only a four-way connection between the stations: two lines respectively for transmission and reception of signals, and two carrying power.

What is claimed:

1. A system for controlling at least two adjacent bowling lanes, each lane having an approach end from which a bowling ball is delivered and a target end toward which the ball is directed at a set of pins, each lane having actuatable means for resetting the pins, the system comprising:

a first control station coupled to the actuatable means for resetting the pins;

a second control station coupled to a central control unit;

a video camera coupled to the second control station and having an angle of view which detects a position of the pins on each of the two adjacent lanes, the video camera positioned between the two adjacent lanes and providing a first signal coupled to the first control station, said first signal being an encoded signal derived from an image viewed by the camera, wherein the encoded signal represents a comparison in position of the pins on the two adjacent lanes between an initial position and a position after the delivery of the ball, said initial position representing a preprogrammed map of said pins on the lanes before delivery of said ball, said comparison in pin positions determining a computation of a bowling score of the two adjacent lanes; and a monitoring means for detecting the passage of balls on the two adjacent lanes, the monitoring means positioned between the two adjacent lanes and providing a second signal coupled to the first control station, said monitoring means comprised of a combination of at least two photocells and at least two reference cells in alignment with each of said photocells, one said combination of cells directed across one of said two adjacent lanes and the other of said combination of cells directed across the other of said two adjacent lanes, wherein said video camera, said monitoring means, and said second control station comprises a single assembly mounted on a channel cover disposed between the two adjacent lanes.

2. A pin and a bowling ball monitoring assembly for monitoring two adjacent bowling lanes in an automated bowling system, each lane having an approach end from which said balls are delivered and a target end toward which the balls are directed at said pins, an actuatable means for resetting the pins and a first control station coupled to the actuatable means for resetting the pins, the assembly comprising:

a video camera having an angle of view which detects a position of the pins on each of two adjacent lanes, the video camera positioned between the two adjacent lanes and providing a first signal coupled to the first control station, said first signal being an encoded signal derived from an image viewed by the camera, wherein the encoded signal represents a comparison in position of the pins on the two adjacent lanes between an initial position and a position after the delivery of the ball, said initial position representing a preprogrammed map of said pins on the lanes before delivery of said ball, said comparison in pin positions determining a computation of a bowling score of the two adjacent lanes; and a monitoring means for detecting the passage of balls on the two adjacent lanes, the monitoring means positioned between the two adjacent lanes and providing a second signal coupled to the first control station, said monitoring means comprised of a combination of at least two photocells and at least two reference cells in alignment with each of said photocells, one of said combinations of cells directed across one of said two adjacent lanes and the other of said combination of cells directed across the other of said two adjacent lanes, wherein the video camera, said second control station, and the monitoring means comprise a single assembly disposed on a channel cover between the two adjacent lanes.

* * * * *